United States Patent [19]

Wolff

[11] Patent Number: 4,765,616

[45] Date of Patent: Aug. 23, 1988

[54] ADJUSTABLE WORKOUT BENCH

[75] Inventor: David W. Wolff, St. Paul, Minn.

[73] Assignee: ParaBody, Inc., Minneapolis, Minn.

[21] Appl. No.: 918,592

[22] Filed: Oct. 10, 1986

Related U.S. Application Data

[63] Continuation of Ser. No. 714,101, Mar. 20, 1985, abandoned.

[51] Int. Cl.[4] ..... A63B 23/00

[52] U.S. Cl. ..... 272/144; 272/123

[58] Field of Search ..... 272/117, 123, 144, 134

[56] References Cited

U.S. PATENT DOCUMENTS

| | | | |
|---|---|---|---|
| 363,751 | 5/1887 | Longfellow | 297/313 |
| 3,820,782 | 6/1974 | Salkeld | 272/134 X |
| 4,098,502 | 7/1978 | Faust | 272/144 |
| 4,396,191 | 8/1983 | Metler | 272/123 |
| 4,542,900 | 9/1985 | Ray | 272/117 X |
| 4,653,751 | 3/1987 | Green | 272/144 |

FOREIGN PATENT DOCUMENTS

| | | | |
|---|---|---|---|
| 2065482 | 7/1981 | United Kingdom | 272/144 |
| 2158362 | 11/1985 | United Kingdom | 272/134 |
| 635999 | 12/1978 | U.S.S.R. | 272/117 |

OTHER PUBLICATIONS

Page from catalog showing "Super Gym Bench" and Heavy Duty 10-in-1 Machine.

Catalog page showing "Body Blaster" by Weider Health and Fitness, Woodland Hills, Calif.

B-101 Combination Bench, Advertising Brochure, printed in 1983.

California Gym Equipment Co. Inc., Marathon Weight Training Division, Advertising Brochure, publication date unknown.

*Primary Examiner*—Richard J. Apley

*Assistant Examiner*—J. Welsh

*Attorney, Agent, or Firm*—Kinney & Lange

[57] ABSTRACT

A workout bench for exercising including weightlifting and other bench oriented exercises which has a barbell rack at one end, and a laterally extending frame member that supports a two section bench. The two sections of the bench are mounted onto a slider that slides along the length of the laterally extending frame member and can be adjusted and held in any desired position along this length. The bench sections are hinged so that they will both incline, and the position of the hinge is controlled by the slider so that the amount of inclination of the bench back section, which rests against supports on the rack at one end can be changed by sliding the slider to a desired location. The shorter seat bench section can be inclined through the use of a separate support member that will incline the bench at a particular angle and which will move with the slider. The hinge for the bench can be adjusted in position relative to the rack so that barbells supported on the rack can be lifted properly. The bench can be moved from one end of the lateral horizontal frame member to the other for permitting proper location for exercising using auxiliary equipment at the outer end of the frame as well.

6 Claims, 1 Drawing Sheet

ADJUSTABLE WORKOUT BENCH

This application is a file wrapper continuation of a prior application Ser. No. 714,101, filed Mar. 20, 1985, now abandoned.

BACKGROUND OF THE INVENTION

1. Field of the Invention

The present invention relates to an improvement in workout benches.

2. Description of the Prior Art

In the prior art a wide variety of various combinations of workout benches have been advanced. Generally speaking, for weightlifting and related exercises, benches have been used which have two bench sections that are hinged together, about a fixed pivot axis. The benches then can be adjusted at various angles with respect to provide support for a body at different positions of incline.

However, the fact that the pivot on the benches is located in a set relationship to the ends of the bench frame means that for people of different body size the bench cannot be positioned for optimum location for weightlifting. For example, when a barbell rack is positioned at one end of the frame, the bench or seat location desirable would be different for persons of different torso lengths.

Additionally, the ability to adjust the one section of the bench at an incline and then move the pivot or hind axes along the workout bench frame permits proper location of the bench in relation to other portions of the frame where optional exercise equipment can be located.

In particular, none of the prior art shows a quickly adjustable slider that will permit moving the hinge between two bench sections laterally relative to a barbell support rack forming a part of the workout system frame.

SUMMARY OF THE INVENTION

The present invention relates to a workout bench arrangement which includes an adjustable bench having two sections that will pivot relative to each other to form a backrest portion and seat portion. The bench sections are mounted onto a slider sleeve that is mounted on a horizontal frame section and which permits adjusting the pivot of the bench sections toward and away from a barbell rack or hind member positioned at one end of the frame, and thus toward and away from the opposite end of the frame, which is adapted to mount additional or auxiliary exercise equipment, such as pivoting rollers and weight assemblies that can be used for doing leg curls and leg extension exercises.

The frame includes a laterally extending generally horizontal member on which the slider is mounted. The bench sections move with the slider as the slider moves. This means that by using a cross bar support on the head or rack portion of the frame and adjusting the slider, the amount of inclination of the longer backrest portion of the bench can be changed, depending on whether the hinge is close to the rack, where the backrest portion is almost vertical, to a position wherein the hinge axis is spaced substantially away from the barbell rack and the backrest portion is inclined gently.

The seat or short portion of the bench can also be inclined with a support that permits it to be moved between at least two positions, one being generally horizontal and the other one being upwardly inclined, so that in at least one position both sections of the bench are coplanar and generally horizontal when the backrest is resting onto a base cross member of the head member or rack portion of the frame.

The ability to adjust the seat and back rest intersection hinge permits the bench to be adjusted properly for different size persons, so that when weights are being supported on the rack above the person exercising, the person's eyes can be located directly below the crossbar of the barbell so that the proper location for lifting is achieved. Additionally, the military press position can be achieved by having the backrest substantially vertical, and directly below the crossbar of the barbells being lifted in a military press move.

In particular the adjustability of this bench permits the ideal position to be achieved for inclining the backrest properly to properly position the weightlifter under the weights that are supported on the rack, and yet permit the bench backrest to be moved horizontally, vertically, or anyplace inbetween.

Because the incline adjustment for the short or seat section of the bench also moves with the slider, once the seat has been formed moving the slider maintains the seat in its inclined position.

DETAILED DESCRIPTION OF THE PREFERRED EMBODIMENTS

Figure 1:
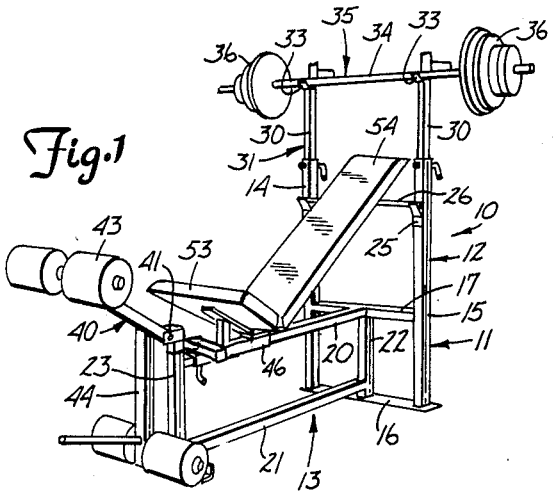
FIG. 1 is a perspective view of a workout bench system made according to the present invention having an adjustable slider made according to the present invention installed thereon.

An adjustable workout bench assembly is shown generally at 10 and includes a frame 11 made up of a head frame or rack 12, and a laterally extending subframe 13 mounted to the rack 12. The rack 12 has a pair of spaced apart upright posts 14 and 15 that are held together with a pair of fixed cross members including a lower cross member 16 and a cross member 17 that is spaced above the floor.

Figure 2:
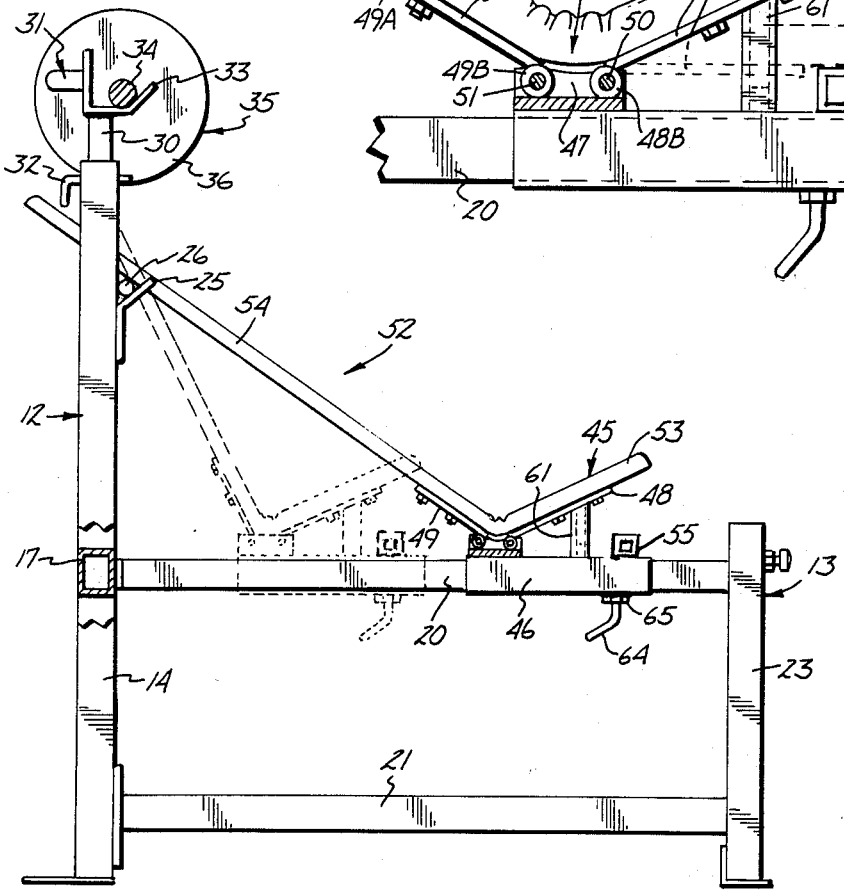
FIG. 2 is a side elevational view of the workout bench shown in FIG. 1.

The laterally extending frame section 13 includes a pair of generally parallel, horizontal frame members including an upper frame member 20 and a lower frame member 21. An upright member 22 extends between the cross members 16 and 17 of the rack, and is fixed to the rack, and an upright end member 23 supports the outer ends of the horizontal posts 20 and 21. As shown in FIG. 1 and also in FIG. 2, the upright members 14 and 15 of the rack have support lugs 25 thereon which are used for supporting a crossbar 26. The crossbar is removable from these supports and there may be one or more sets of the lug type supports 25 mounted onto the upright posts 14. Additionally, the upright posts 14 and 15 are used for telescopically mounting legs 30 of a vertically adjustable barbell or weight support section 31 of the rack. This section 31 is adjustable because the members 30 telescope into the upright posts 14 and 15, and can be held in place with a suitable pin 32 through provided aligning openings. At the upper end of the barbell weight support section 31, barbell saddles 33 are mounted, and the saddles are shaped so that they will support the crossbar 34 of a set of barbells shown generally at 35. The barbells 35 have weights 36 mounted at opposite ends thereof in a conventional manner.

It can be seen that the saddles 33 are positioned so the crossbar 34 is supported just slightly ahead of the rack, and generally in line with the front edge of the uprights 14 and 15.

As can also be seen in FIG. 1 as a typical attachment, a pivoting support indicated generally at 40 is mounted on a support held onto the upright member 23 in a suitable manner for pivoting about a generally horizontal pivot at the location indicated generally at 41, and when the bench is in a horizontal position, as will be explained. Rollers 43 of this pivotiing assembly 40 can be pivoted to lift weights mounted at the lower end of a leg 44 which moves with the pivoting assembly 40, for doing leg curls and the like. Additionally, the upright member 23 can be used for supporting vertical pull bars on cables and pulleys for lifting different weights at the remote end of the frame, that is, the end remote from the rack portion.

These additions or accessories at the remote end of the frame enhance the operability of the overall workout bench system, but the devices themselves are conventional devices.

A bench assembly indicated generally at 45, as shown includes a slider 46 comprising a sleeve that is slidably mounted for movement along the generally horizontal, laterally extending frame member 21. Slider 46 fits over the square tube frame member 21, and the slider sleeve also is a square tube. The slider 46 as shown, has a pair of pivot hinge assemblies mounted adjacent one end thereof, as can perhaps best be seen at 44 in FIG. 3. In this instance, a pair of upright side members 47 are mounted on the slidable, and the side members 47 mount first and second hinge assemblies 48 and 49, respectively. The hinge assembly 48 includes a tongue that is shown at 48A, and a hub 48B that is mounted onto a pin 50 that passes through the side of support members 47. The hinge member 49 includes a tongue 49A and a hub 49B that is mounted onto a pin 51 which is parallel of the pin 50 and extends between the side members 47.

Each of the tongues 48A and 49A is bolted to a separate bench section. The bench is shown generally at 52, and includes a relatively thin padded surface and a rigid backing member in a conventional manner. A bench seat section is shown generally at 53 and a backrest section is shown at 54. The seat section 53 is mounted onto the tongue 48A and extends outwardly toward the outer end of the lateral frame 13, while the backrest section 54 is mounted to tongue 49A and extends from the hinge pin 51 toward the rack or head frame 12.

Figure 3:
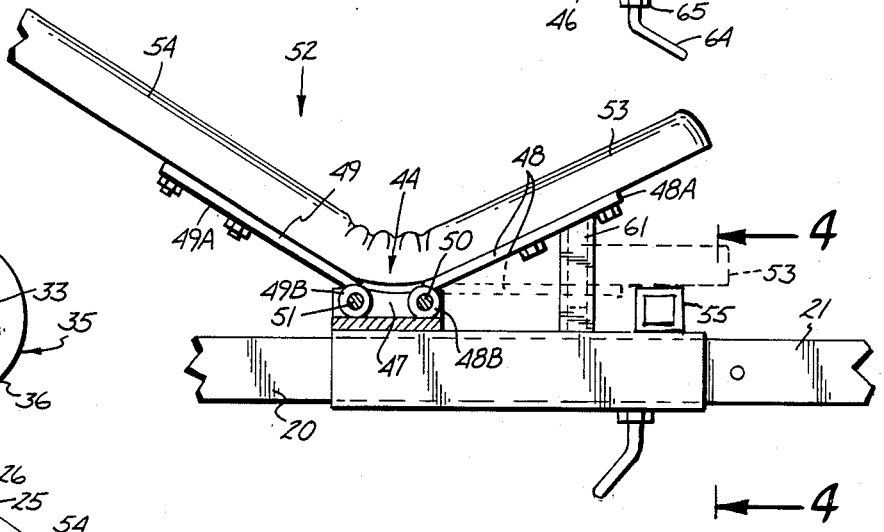
FIG. 3 is a fragmentary enlarged side view showing an adjustable slider installed on a laterally extending portion of the frame of the bench of FIG. 1.

The slider 46 also has a cross support 55 mounted thereon at the end opposite from the hinge assembly held by side members 47, and the support 55 is made so that it will support the underside of the bench seat section 53 when the bench seat section is substantially horizontal as shown by dotted lines in FIG. 3.

Figure 5:
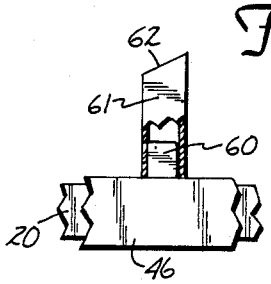
FIG. 5 is a fragmentary side view showing a seat inclination adjustment member for use with the slider of the present invention.
Figure 4:
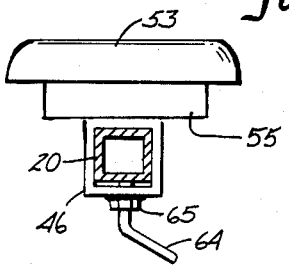
FIG. 4 is a sectional view taken along the line 4—4 in FIG. 3.

Additionally, the slider 46 has a lug 60 (see FIG. 5) on the upper surface thereof that is of size to fit within a removable bench section adjustment post 61, and when it is desired to provide the bench seat section 53 at an incline to form a seat, generally as shown in FIG. 3, the bench section 53 can be hinged up about its hinge pin 50, and the height adjustment post 61 placed over the lug 60. The post 61 has an inclined upper end surface plane along the line shown at 62 aligned with the tongue portion 48A and support this tongue, and thus the bench section 53 at an inclined position.

The bench sections 53 and 54 are bolted securely to the respective hinge tongues, and the pins 50 and 51 hold the bench pad securely with respect to the slider. Slider 46, as shown a sleeve, can be adjusted along the generally horizontal laterally extending frame member 20 to any desired position and can be locked in place with a suitable lock screw 64. The lock screw is threaded through a threaded nut 65 that is welded or otherwise fixed to the slider sleeve 46, and will thread through a provided opening to bear against the under surface of the frame member 20. Upon tightening the lock screw will securely hold the slider sleeve from sliding. That means the position of the hinge region of the bench seat and back can be adjusted relative to the head frame or rack 12 along the entire length of frame member 20.

In normal use, the crossbar 26 is used for supporting the back section 54 when it is to be used as a seat, and as shown moving the slider 46 causes a different inclination of the back, and a movement of the generaly hinge region of the bench indicated generally at 44. This means that the person seated on the bench and using the barbell set 35 can position the hinge region 44 where the back section 54 and the seat section 53 of the bench merge or are connected so that when the person is positioned on the bench and seated in place, a person's eyes can be located directly below the crossbar 34 for the weight set.

Further, sliding the slider member 46 all the way to near the head frame or rack 12 will make the back section 54 of the bench substantially vertical and will permit positioning of the person doing the exercising properly for executing a seated military press of the barbell.

Thus the slider 46, in the form shown, a sleeve, can be adjusted so that the bench is positioned to have the back section 54 at substantially any degree of incline.

If the bench 54 is to be used in a position wherein both bench sections 53 and 54 are coplanar, either horizontal or with the entire frame inclined, as is sometimes done, the crossbar 26 can be removed and the bench backrest section 54, will rest on the cross member 17 of the rack and this is positioned so that the top edge of this cross member aligns with the top edge of the tongue 49A and the bench backrest section 54 will be generally horizontal.

If the seat section 53 then is to be lowered, it is first raised slightly so that the support post 61 can be removed from the locator lug 60, and then the bench seat section will hinge down and the outer end of the bench section 53 will be supported in the top of the support 55 which will keep the bench section 53 generally horizontal and coplanar with the bench section 54. The slider 46 can be then positioned at any desired location along the upper frame member 20 to accommodate the exercises that are being performed. For example, with the auxiliary pivoting member 40, the person exercising would lay face down with the head adjacent the head frame, or between the uprights 14 and 15 of the head frame or rack, and then leg curls could be performed with the pivoting member 40 by using rollers 43.

The slider permits greater versatility for various exercising to ensure that complete exercise can be carried out, and that weightlift training also can be accomplished with precision and proper positioning.

The frame can be made of suitable steel tube, and of course the bench 52 can be covered with a tough cover, and foam padded as desired.

Although the present invention has been described with reference to preferred embodiments, workers skilled in the art will recognize that changes may be made in form and detail without departing from the spirit and scope of the invention.

What is claimed is:

1. A workout bench for use in lifting weights comprising a frame, a rack at one end of said frame having means thereon for supporting barbells having weights mounted onto a crossbar, said frame further including a laterally extending frame member extending laterally outwardly from said rack, and a bench for mounting on said laterally extending frame member and for being supported at least partially on said rack, the improvement comprising:

said bench comprising two bench sections, each having first and second ends, the first bench section being substantially longer than the second bench section;

a slider member slidably mounted on said laterally extending frame member for movement toward and away from said rack;

means for mounting both of said bench sections on said slider member for independent pivotal movement of the bench sections permitting the second ends of said bench sections to be moved upwardly and downwardly relative to the slider member, said means for mounting comprising two separate hinge members mounted to the slider member about spaced, parallel horizontal hinge axes, a first of said hinge members supporting a first end of a first of said bench sections, and a second of said hinge members supporting a first end of a second of said bench sections, the hinge member for said second bench section permitting the second bench section to be hinged about its second pivot axis so that the outer end thereof is raised substantially above the hinge axis;

removable support means positioned between the second bench section and the slider member for supporting said second bench section at an inclined relationship with respect to the slider member and the laterally extending frame member; and means to adjustably fix said slider member in selected positions along said laterally extending frame member to locate the first ends of the bench sections at desired locations relative to said rack, the removable support means being movable with the slider member to permit the second bench section to remain at a fixed incline as the slider member is positioned at different positions along the laterally extending frame member.

2. The apparatus as specified in claim 1 wherein said removable support means comprises a locater lug mounted on said slider member, and a removable upright post positionable on said locater lug and engagable with the underside of said second bench section to support said second bench section at its inclined position relative to the slider member in each position of the slider member along the laterally extending frame member.

3. The apparatus as specified in claim 1 wherein said laterally extending frame member comprises a tubular member, and the slider member is a sleeve that slidably fits over said tubular member, said means to adjustably fix comprising a threadable screw mounted on said sleeve and threadable to engage said laterally extending frame member.

4. The apparatus as specified in claim 1 wherein said laterally extending frame member is centered on and connected to said rack, a cross member on said rack having an upper edge substantially along a horizontal line passing though the axes of pivot of the hinge members, the outer end of the first bench section being movable to a rest position supported on the upper edge of the cross member, wherein the first bench section is substantially coplanar with the second bench section when the removable support means for the second bench section is removed and the second bench section is supported in a rest position.

5. The apparatus as specified in claim 4 including a horizontal bench support bar supported on said rack to support the outer end portion of said first bench section, the slider being adjustable along said laterally extending frame member so that said first bench section moves from a substantially vertical position to a more inclined position as supported on said bench support bar for adjustment of working positions of the first bench section while the second bench section is permitted to remain in its desired position.

6. A workout bench for use in lifting weights comprising a frame, a rack at one end of said frame having means thereon for supporting a bench support crossbar and barbells for weight lifting onto a crossbar, said frame further including a laterally extending frame member extending laterally outwardly from said rack, and a bench for mounting on said laterally extending frame member and for being supported at least partially on said rack, the improvement comprising:

said laterally extending frame member comprising a first tube;

said bench comprising two bench sections, each having first and second ends, the first bench section being substantially longer than the second bench section and the second end being of length to rest on a crossbar supported on the rack;

a slider member comprising a tube section having a cross section complemental to the cross section of the first tube and slidably mounted over said laterally extending frame member, for movement toward and away from said rack;

means for mounting both of said bench sections on said slider member, the first bench section being mounted for independent pivotal movement permitting the second end of said first bench section to be moved upwardly and downwardly relative to the slider member comprising hinge means mounted to the slider member for supporting the first bench section for independent hinging movement;

support means positioned between the second bench section and the slider member for supporting said second bench section with respect to the slider member and the laterally extending frame member; and means to adjustably fix said slider member in a selected positions along said laterally extending frame member comprising means defining a threaded opening on the tube section of the slider member and a single hand operable screw threaded in the threaded opening and adapted to be threaded to bear against the laterally extending frame member to clamp the slider member in such selected positions to locate the first end of the first bench sections at desired locations relative to said rack for adjusting the position of the bench relative to the rack and thus to permit adjusting the angle of inclination of the first bench section when the second end thereof is resting on a bench support cross bar on the rack.

* * * * *